US009367037B2

(12) United States Patent
Kaelin et al.

(10) Patent No.: US 9,367,037 B2
(45) Date of Patent: Jun. 14, 2016

(54) TIMEPIECE BARREL

(71) Applicant: ETA SA Manufacture Horlogere Suisse, Grenchen (CH)

(72) Inventors: Laurent Kaelin, Sonvilier (CH); Arthur Queval, Lutry (CH); Martin Vautherot, Publier (FR)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/428,079

(22) PCT Filed: Oct. 21, 2013

(86) PCT No.: PCT/EP2013/071988
§ 371 (c)(1),
(2) Date: Mar. 13, 2015

(87) PCT Pub. No.: WO2014/095125
PCT Pub. Date: Jun. 26, 2014

(65) Prior Publication Data

US 2015/0253731 A1 Sep. 10, 2015

(30) Foreign Application Priority Data

Dec. 18, 2012 (EP) ..... 12197741

(51) Int. Cl.
*G04B 1/16* (2006.01)
*G04B 1/14* (2006.01)
*G04B 1/18* (2006.01)

(52) U.S. Cl.
CPC *G04B 1/16* (2013.01); *G04B 1/145* (2013.01); *G04B 1/18* (2013.01)

(58) Field of Classification Search
CPC ..... G04B 1/10; G04B 1/14; G04B 1/145; G04B 1/16; G04B 1/165; G04B 1/18; G04B 33/14; G04B 35/00
See application file for complete search history.

(56) References Cited

U.S. PATENT DOCUMENTS 168,581 A 10/1875 Potter
730,103 A 6/1903 Erickson
(Continued)

FOREIGN PATENT DOCUMENTS

CH 15286 A 4/1898
CH 83330 A 12/1919
(Continued)

OTHER PUBLICATIONS

International Search Report issued Feb. 6, 2014 in PCT/EP2013/071988 filed Oct. 21, 2013.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece barrel for pivotal assembly between a plate and a bar and including at least one spring housed between a pivoting drum and a cover and hooked between the drum at an outer end thereof and an arbor at an inner end thereof, the arbor pivoting integrally with a ratchet about a pivot axis. The barrel includes a one-piece sub-assembly coaxial to the arbor and including, about a boss, at least the ratchet and/or the arbor, and the guide arbor in the plate is fitted into the boss which is integral with the ratchet, the boss forming the guide member in the bar, making it possible to assemble the bar and plate with subsequent attachment of the arbor.

14 Claims, 2 Drawing Sheets

(56) References Cited

U.S. PATENT DOCUMENTS

| | | | | | |
|---|---|---|---|---|---|
| 804,728 | A | | 11/1905 | Johnson | |
| 978,613 | A | * | 12/1910 | Mehl | G04B 1/16 368/143 |
| 996,499 | A | * | 6/1911 | Marshall | G04B 1/16 368/143 |
| 1,033,020 | A | * | 7/1912 | Kern | G04B 1/16 191/93 |
| 1,561,673 | A | | 11/1925 | Ulery et al. | |
| 3,846,974 | A | | 11/1974 | Giger | |
| 4,077,201 | A | | 3/1978 | Perrot | |
| 2010/0149928 | A1 | * | 6/2010 | Reynard | G04B 1/16 368/206 |
| 2010/0322039 | A1 | * | 12/2010 | Kury | G04B 31/0123 368/142 |
| 2013/0039155 | A1 | * | 2/2013 | Kury | G04B 31/0123 368/143 |
| 2013/0064047 | A1 | * | 3/2013 | Kaelin | G04B 33/12 368/220 |
| 2013/0223194 | A1 | * | 8/2013 | Cattin | G04B 1/16 368/143 |
| 2014/0211595 | A1 | * | 7/2014 | Capt | G04B 1/145 368/142 |

FOREIGN PATENT DOCUMENTS

| | | | |
|---|---|---|---|
| EP | 2570864 | A1 | 3/2013 |
| FR | 1034443 | A | 7/1953 |
| FR | 2210784 | A1 | 7/1974 |
| FR | 2329000 | A1 | 5/1977 |
| GB | 647819 | A | 12/1950 |

* cited by examiner

TIMEPIECE BARREL

CROSS-REFERENCE TO RELATED APPLICATIONS

This is a National phase application in the United States of International Patent application PCT/EP2013/071988 filed Oct. 21, 2013 which claims priority on European patent application No. 12197741.7 filed Dec. 18, 2012. The entire disclosure of the above patent applications are herein incorporated by reference.

FIELD OF THE INVENTION

The invention concerns a timepiece barrel for pivotal assembly between a plate and a bar and including at least one spring, housed between a pivoting drum and a cover and hooked between said drum at the outer end thereof and an arbor at the inner end thereof, said arbor being pivotally integral with a ratchet about a pivot axis, said barrel including a one-piece sub-assembly coaxial to said pivot axis and containing, about a boss, at least said ratchet and/or said arbor.

The invention also concerns a timepiece movement including at least one plate and a bar and a barrel of this type.

The invention also concerns a watch including a movement of this type.

The invention concerns the field of timepiece mechanisms, and more specifically energy storage mechanisms, of the mainspring barrel, striking barrel or similar type.

BACKGROUND OF THE INVENTION

In order to increase the power reserve, by increasing the number of turns of a mainspring, secured at the inner end thereof to a core formed either by an arbor, which is generally cylindrical, or by a more solid boss, one solution consists in decreasing the diameter of the barrel arbor and of the associated boss, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the diameter of the core is too small.

In the conventional barrel architecture, a ratchet is axially mounted on a barrel arbor or on a core, via a square, with the ratchet usually being secured by an axial screw. The dimension of this screw and that of the square thus define the minimum diameter of a pivot bearing surface. A shoulder joined to this pivot bearing surface limits the axial shake of the arbor or of the core relative to a main plate or to a bar carrying a jewel or similar element.

In particular, it is not sufficient merely to reduce all of the dimensions, since the cross-sections of material are then insufficient to ensure fatigue resistance.

The issue is thus to reconcile the smallest possible diameter, to allow the largest possible power reserve, with rigidity in the ratchet drive.

US Patent Application No 804728A in the name of JOHNSON describes a barrel whose arbor carries a threaded hub, which in turn includes a mainspring. Two components are therefore necessary for the internal holding of the spring. The drum barrel is guided by a jewel which is not in a single piece with the arbor. The rewinding ratchet is located on the other side of the barrel bar. The portion carrying the square driving the ratchet is not formed by a collar, but by the end of the arbor which protrudes beyond the bar, on the opposite side to the drum.

US Patent Application No 168581A, in the name of Potter, published in 1875, discloses a barrel with a substantially smooth arbor pivoting at both ends thereof between two plates on either side of a main plate in which the barrel is embedded and which forms a cover for the drum. This arbor carries a hollow fusee carrying a wheel and onto which the inner end of the spring is hooked. In abutment on the fusee, the arbor carries the drum onto which the outer end of the spring is hooked. Next, the arbor carries the ratchet, which is in abutment on a small step of the arbor and confined underneath one of the lateral plates.

FR Patent Application No 2329000A1 in the name of ETA discloses a barrel with an arbor having a non-cylindrical shaft, the hook for hooking the spring being contained in a recess delimited by a geometrical cylinder defined by the upper and lower bearing surfaces of the shaft CH Patent Application No 83330A in the name of BEAULIEU WATCH CO describes a barrel with no cover, including a core screwed onto an arbor. The drum is loosely fitted onto the arbor, between a bearing surface of the arbor and the core. Here too, two components are required for the internal holding of the spring.

FR Patent Application No 2210784A1 in the name of ETA discloses a barrel with an arbor comprising longitudinal grooves for hooking the spring.

CH Patent Application No 15286A in the name of DANASINO, published in 1898, discloses a barrel with a smooth arbor which carries a hollow fusee including a ratchet. This hollow fusee has two shoulders receiving the drum and the cover. The cross-section of the mainspring increases gradually from the outer end towards the inner end thereof.

US Patent Application No 1561673A in the name of ULERY, published in 1925, discloses a barrel with an arbor, and including a collar acting as support for a toothed wheel driving the drum. This arbor includes two housings at its opposite ends, one of which receives a pin for guiding the arbor in a bearing housed in a main plate and holding the end of said arbor in said bearing, and the other of which receives a pinned conical peg which has a similar bearing surface for upper guiding in a bar, and, at the distal end thereof, a ratchet drive square.

EP Patent Application No 2570864A1 in the name of BLANCPAIN discloses a barrel with a core which includes, in succession, means for securing a ratchet, and/or a first pivot bearing surface in a main plate, a drum pivot bearing surface, and collar protruding relative to said bearing surface and abutting on an inner surface of the drum towards the spring, set back radially relative to the collar, a spring receiving surface, then, set back radially relative thereto, a pivot bearing surface for a cover closing the barrel, and a second pivot bearing surface in a main plate.

SUMMARY OF THE INVENTION

The invention proposes to improve the design of known barrels devised for a large power reserve by procuring a high level of rigidity, particularly as regards the ratchet, while maintaining a reduced number of components, and acceptable machining costs, or, preferably, more economical costs than for known barrels.

The invention therefore concerns a timepiece barrel for pivotal assembly between a plate and a bar and including at least one spring, housed between a pivoting drum and a cover and hooked between said drum at the outer end thereof and an arbor at the inner end thereof, said arbor being pivotally integral with a ratchet about a pivot axis, said barrel including a one-piece sub-assembly coaxial to said pivot axis and containing, about a boss, at least said ratchet and/or said arbor, characterized in that said boss comprises means for guiding in rotation said drum, and means for guiding pivoting of said barrel in said bar, and defines means for limiting the axial shake of said drum relative to said bar, via a lower shoulder on said drum side and an upper shoulder on said plate side, further characterized in that said arbor comprises means for guiding said barrel in said plate, and means for guiding said cover when said cover is guided onto said barrel, and in that said arbor directly carries the inner end of said spring, and further characterized in that said one-piece sub-assembly comprises said ratchet and said boss, which defines in the inner part thereof a pipe, which comprises an outer bearing surface onto which said drum is pivotally guided, and a bore into which said arbor is driven, pivoting integrally with said boss.

According to a characteristic of the invention, said one-piece sub-assembly is pivoted on an upper bearing surface in a bore of said bar or of a jewel comprised in said bar, and comprises an upper shoulder, whose travel is limited by a lower surface of said bar or of said jewel, said ratchet being comprised between said upper shoulder and a lower shoulder comprised in said one-piece sub-assembly on said boss; said lower shoulder limits the travel of an upper surface of said drum, said drum pivots in a bore comprised therein with a cylindrical bearing surface of said boss.

According to another characteristic of the invention, the shake of said drum is limited in lower abutment relative to said ratchet, by an upper surface of said drum which is limited by a lower shoulder of said one-piece sub-assembly, the shake of said ratchet is limited in lower abutment relative to said bar, by an upper shoulder of said one-piece sub-assembly which is limited by a lower surface of said bar or of a jewel comprised in said bar, and the shake of said cover is limited in upper abutment relative to said plate by a lower surface of said cover which is limited by an upper surface of said plate or of a jewel comprised in said plate.

According to yet another characteristic of the invention, said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and with a Young's modulus of between 200 and 240 GPa and a shearing modulus of between 80 and 100 GPa, said spring has a width to thickness ratio of between 3 and 23, and the ratio between the maximum radius of a bearing surface of the spring of said arbor and the thickness of said spring is between 3 and 9.

The invention also concerns a timepiece movement including at least one plate and a bar and a barrel of this type.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
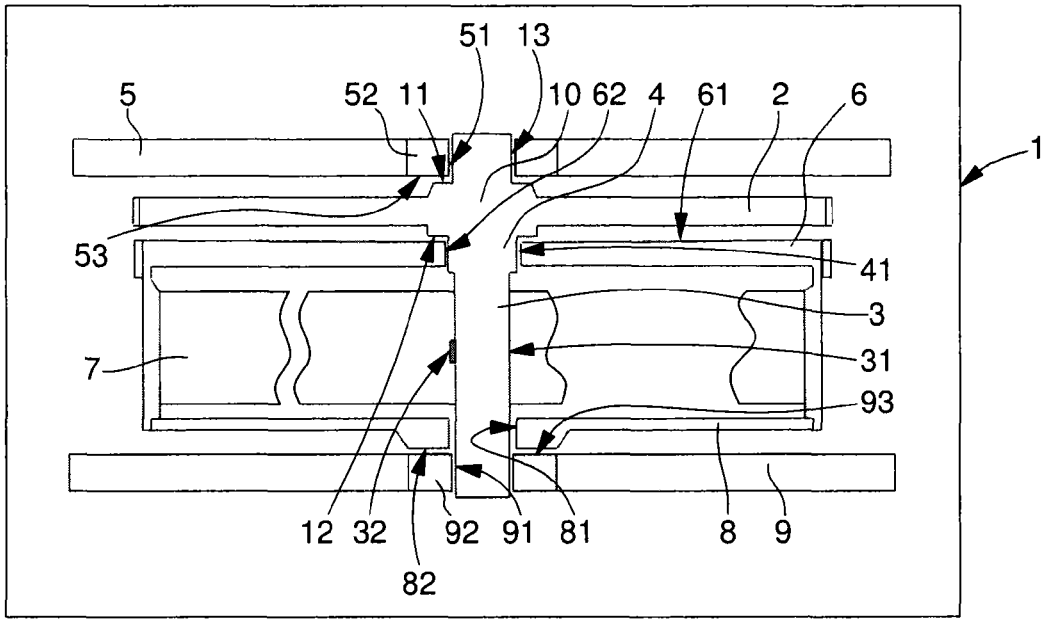
FIG. 1 shows a schematic cross-section through the pivot axis of a barrel according to a first variant of the invention.

The invention concerns the field of timepiece mechanisms, and more specifically energy storage mechanisms, of the mainspring barrel, striking barrel or similar type.

The invention thus concerns a timepiece barrel 1 for pivotal assembly between a plate 9 and a bar 5 and including at least one spring 7. This spring 7 is housed between a pivoting drum 6 and a ratchet 8 and is hooked between drum 6, at the outer end thereof, and an arbor 3, at the inner end thereof. Arbor 3 is mounted to pivot integrally with a ratchet 2 about a pivot axis D.

Barrel 1 includes a single-piece sub-assembly 10 coaxial with arbor 3 and containing, about a boss 4, at least ratchet 2 and arbor 3.

This one-piece sub-assembly 10 is pivoted on an upper bearing surface 13 in a bore 51 of bar 5 or of a jewel 52 comprised in bar 5 and includes an upper shoulder 11, whose travel is limited by a lower surface 53 of bar 5 or of jewel 52. Ratchet 2 is comprised between upper shoulder 11 and a lower shoulder 12 comprised in one-piece sub-assembly 10 on boss 4. This lower shoulder 12 limits the travel of an upper surface 61 of drum 6. Drum 6 pivots in a bore 62 comprised therein with a cylindrical bearing surface 41 of boss 4.

Arbor 3 includes a preferably cylindrical bearing surface 31, which preferably has a smaller diameter than that of cylindrical bearing surface 41 of boss 4. Arbor 3 carries spring 7, either on bearing surface 31 thereof, on which spring 7 is immobilised by friction or welded, or on a hook 32 comprised in arbor 3 around such a bearing surface 31. Arbor 3 is pivotally mounted in a bore 91 of plate 9 or of a jewel 92 comprised in plate 9. In a preferred embodiment, bearing surface 31 is extended and forms the pivoting surface in said bore 91 or said jewel 92.

Drum 6 carries a cover 8 which preferably, but not necessarily, pivots integrally with drum 6, and has a bore 81 that cooperates with a bearing surface 31 of arbor 3. The travel of a lower surface 82 of cover 8 is limited by an upper surface 93 of plate 9 or of a jewel 92 housed in plate 9, with a bore 91 of plate 9 or of jewel 92 acting as pivot for bearing surface 31 of arbor 3.

The shake of drum 6 is limited in upper abutment relative to ratchet 2, by an upper surface 61 of drum 6, which is limited by a lower shoulder 12 of one-piece sub-assembly 10.

The shake of ratchet 2 is limited in upper abutment relative to bar 5, by an upper surface 11 of one-piece sub-assembly 10, which is limited by a lower surface 53 of bar 5 or of a jewel 52 comprised in bar 5.

The shake of cover 8 is limited in upper abutment relative to plate 9 by a lower surface 82 of cover 8, which is limited by an upper surface 93 of plate 9 or of a jewel 91 comprised in plate 9.

The mainspring may be made of various materials: carbon steel, stainless steel, "Nivaflex®", silicon, DLC, quartz, glass or similar. In a particular application, spring 7 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 7 preferably has a width to thickness ratio of between 3 and 23, and more particularly between 9 and 21.

Also, the maximum radius of bearing surface 31 of arbor 3 (ignoring any excess thickness of a hook 32), made of steel or stainless steel, for example of 4C27A hardenable steel (also called according to the various standards 1.4197, ASTM 420F, or DIN X22 CRMoNiS 13 1), relative to pivot axis D is less than nine times the maximum thickness of spring 7. In particular, with the illustrated embodiments it is possible to obtain a ratio between the maximum radius of bearing surface 31 of arbor 3 and the thickness of spring 7 of between 3 and 9, and preferably between 4 and 6, preferably close to 5.

Figure 2:
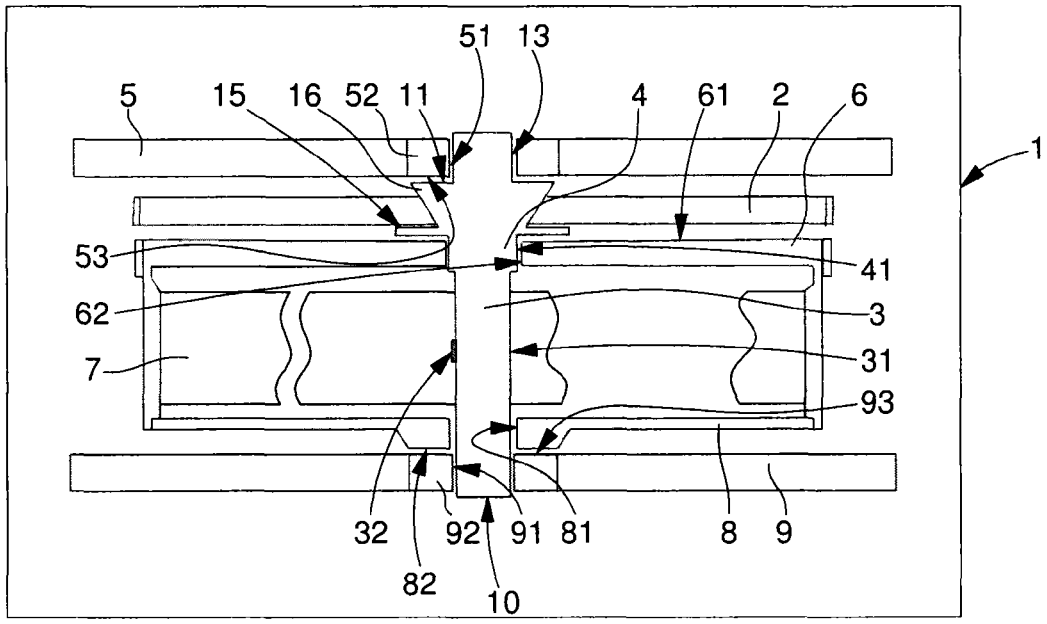
FIG. 2 shows a schematic cross-section through the pivot axis of a barrel according to a second variant of the invention.
Figure 3:
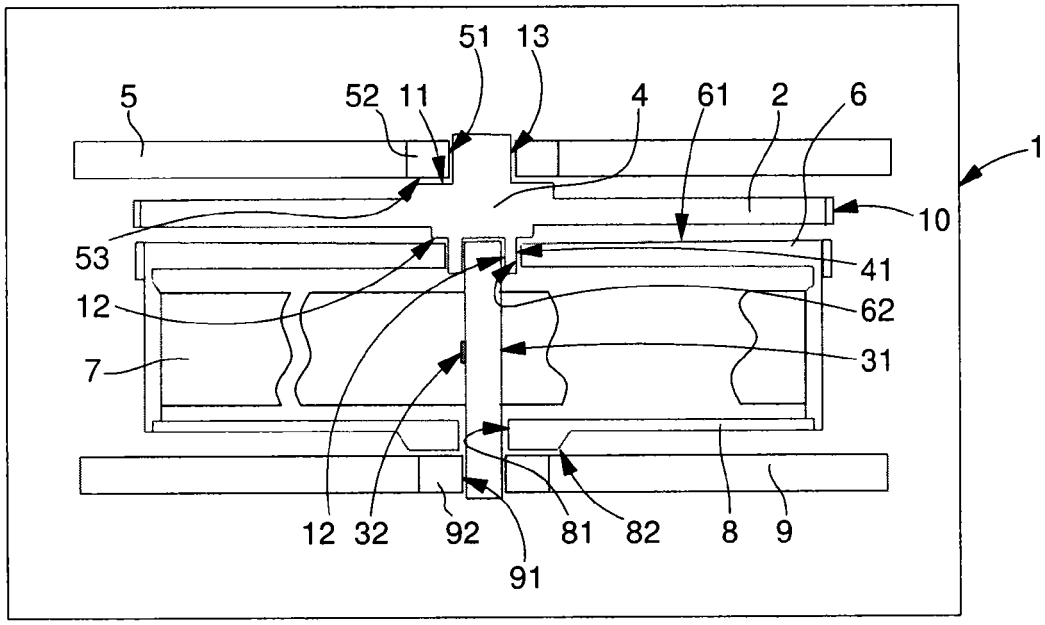
FIG. 3 shows a schematic cross-section through the pivot axis of a barrel according to a third variant of the invention.
Figure 4:
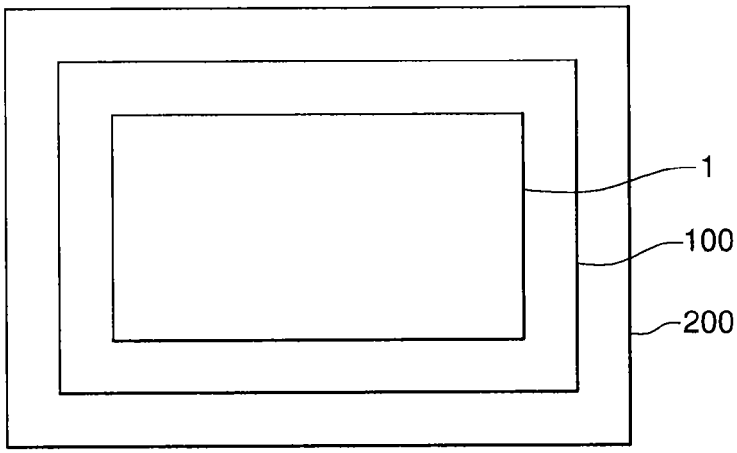
FIG. 4 shows a schematic block diagram of a timepiece including a movement which in turn includes a barrel according to the invention.

FIGS. 1 to 3 illustrate three preferred but non-limiting variants, which are each explained in detail below:

First variant of FIG. 1:

Barrel 1 includes a one-piece sub-assembly 10 containing a ratchet 2, an arbor 3 and a boss 4, underneath a bar 5.

This one-piece sub-assembly 10 is pivoted on an upper shoulder 13 in a bore 51 of bar 5 or of a jewel 52 of bar 5 and includes an upper shoulder 11, whose travel is limited by a lower surface 53 of said bar 5 or of said jewel 52. Ratchet 2 is contained between upper shoulder 11 and a lower shoulder 12 of one-piece sub-assembly 10 on boss 4.

This lower shoulder 12 limits the travel of an upper surface 61 of a drum 6. Drum 6 pivots in a bore 62 with a cylindrical bearing surface 41 of boss 4.

Arbor 3 has a smaller diameter than that of boss 4, and carries a hook 32 for internal hooking of a spring 7, or directly carries said spring 7 on a bearing surface 31 to which spring 7 is fixed by friction, or by welding or other means.

Drum 6 carries a cover 8 which is integral with drum 6 and has a bore 81 that cooperates with a bearing surface 31 of arbor 3.

The motion of a lower surface 82 of cover 8 is limited by the upper surface 93 of a plate 9 or of a jewel 92 housed in a plate 9. Bore 91 of plate 9 or of jewel 92 acts as a pivot for bearing surface 31 of arbor 3.

One-piece sub-assembly 10 comprises a bearing surface 41 for boss 4 which pivots in a bore 62 of drum 6 which is also pivotally mounted.

One-piece sub-assembly 10 includes a bearing surface 31 of arbor 3 which pivots in a bore 81 of cover 8 which is also pivotally mounted.

One-piece sub-assembly 10 comprises in its upper portion, above ratchet 2, a bearing surface 13 which pivots in a bore 51 of bar 5, or, if appropriate, of jewel 52 of bar 5 which is stationary.

One-piece sub-assembly 10 comprises in its lower portion, below cover 8, a bearing surface 31 of arbor 3, which pivots in a bore 91 of plate 9 or, if appropriate, of jewel 92 of plate 9 which is stationary.

The shake of drum 6 is limited in lower abutment relative to ratchet 2 by the upper surface 61 of drum 6, which is limited by lower shoulder 12 of one-piece sub-assembly 10 which is equivalent to the lower abutment of ratchet 2.

The shake of ratchet 2 is limited in lower abutment relative to bar 5, by the upper shoulder 11 of one-piece sub-assembly 10, which is limited by lower surface 53 of bar 5 or of jewel 52.

The shake of cover 8 is limited in upper abutment relative to plate 9 by lower surface 82 of cover 8, which is limited by upper surface 93 of plate 9 or of jewel 91.

The core diameter is not limited by anything other than the resistance of the material to shearing stress, nor is the diameter of arbor 3, which allows a very small arbor diameter to be created, and a very favourable K factor to be obtained.

Second variant of FIG. 2:

Barrel 1 comprises a one-piece sub-assembly 10 containing an arbor 3, and a boss 4 underneath a bar 5. This one-piece sub-assembly 10 receives, in abutment on a shoulder 15, a ratchet 2 which is then mounted on a rivet 16 of boss 4, to become pivotally integral with one-piece sub-assembly 10.

This one-piece sub-assembly 10 is pivoted on an upper bearing surface 13 in a bore 51 of bar 5 or of a jewel 52 of bar 5 and boss 4 includes an upper shoulder 11, whose travel is limited by lower surface 53 of bar 5 or of jewel 52. Ratchet 2 is comprised between upper shoulder 11 and a lower shoulder 12 of boss 4 of one-piece sub-assembly 10.

This lower shoulder 12 limits the travel of an upper surface 61 of a drum 6. Drum 6 pivots in a bore 62 with a cylindrical bearing surface 41 of boss 4.

Arbor 3 has a smaller diameter than that of boss 4, and carries a hook 32 for internal hooking of a spring 7, or directly carries said spring 7 on a bearing surface 31 to which spring 7 is fixed by friction, or by welding or other means.

Drum 6 carries a cover 8 which is integral with drum 6 and has a bore 81 that cooperates with a bearing surface 31 of arbor 3.

The motion of a lower surface 82 of cover 8 is limited by the upper surface 93 of a plate 9 or of a jewel 92 housed in a plate 9. Bore 91 of plate 9 or of jewel 92 acts as a pivot for bearing surface 31 of arbor 3.

One-piece sub-assembly 10 comprises a bearing surface 41 for boss 4 which pivots in a bore 62 of drum 6 which is also pivotally mounted.

One-piece sub-assembly 10 includes a bearing surface 31 of arbor 3 which pivots in a bore 81 of cover 8 which is also pivotally mounted.

One-piece sub-assembly 10 comprises in its upper portion, above ratchet 2, a bearing surface 13 which pivots in a bore 51 of bar 5, or of jewel 52 of bar 5 which is stationary.

One-piece sub-assembly 10 comprises in its lower portion, below cover 8, a bearing surface 31 of arbor 3, which pivots in a bore 91 of plate 9 or of jewel 92 of plate 9 which is stationary.

This variant has three shake corrections.

The shake of drum 6 is limited in lower abutment relative to boss 4, by upper surface 61 of drum 6, which is limited by lower shoulder 12 of boss 4 of one-piece sub-assembly 10.

The shake of drum 4 is limited in lower abutment relative to bar 5, by upper shoulder 11 of boss 4, which is limited by lower surface 53 of bar 5 or of jewel 52.

The shake of cover 8 is limited in upper abutment relative to plate 9 by lower surface 82 of cover 8, which is limited by upper surface 93 of plate 9 or of jewel 91.

The boss diameter at the drum is not limited by anything other than the resistance of the material to shearing stress, nor is the diameter of arbor 3, which allows a very small arbor diameter to be created, and a very favourable K factor to be obtained.

Third variant of FIG. 3: this third variant includes a guide arbor in the plate fitted into the core which is integral with the ratchet, with the boss forming the guide member in the bar; this variant permits assembly between the bar and plate with subsequent attachment of the arbor.

Barrel 1 comprises a one-piece sub-assembly 10 containing a ratchet 2 and a boss 4 underneath a bar 5. Boss 4 defines in the inner portion thereof a pipe, which comprises an outer bearing surface 41 and a housing or a bore 45 into which is driven an arbor 3, which then pivots integrally with boss 4.

Arbor 3 may therefore be very simple, in particular comprising a single cylindrical bearing surface 31, and a hook 32 can therefore be machined easily and economically.

This one-piece sub-assembly 10 is pivoted on an upper bearing surface 13 in a bore 51 of bar 5 or of a jewel 52 of bar 5 and includes an upper shoulder 11, whose travel is limited by a lower surface 53 of bar 5 or of jewel 52. Ratchet 2 is contained between upper shoulder 11 and a lower shoulder 12 of one-piece sub-assembly 10, which is adjacent to the pipe of boss 4 and to its cylindrical bearing surface 41.

This lower shoulder 12 limits the travel of an upper surface 61 of a drum 6. Drum 6 pivots in a bore 62 with a cylindrical bearing surface 41 of boss 4.

Arbor 3 has a smaller diameter than that of boss 4, and carries a hook 32 for internal hooking of a spring 7, or directly carries said spring 7 on a bearing surface 31 to which spring 7 is fixed by friction, or by welding or other means.

Drum 6 carries a cover 8 which is integral with drum 6 and has a bore 81 that cooperates with a bearing surface 31 of arbor 3.

The motion of a lower surface 82 of cover 8 is limited by the upper surface 93 of a plate 9 or of a jewel 92 housed in a plate 9. Bore 91 of plate 9 or of jewel 92 acts as a pivot for bearing surface 31 of arbor 3.

One-piece sub-assembly 10 comprises a bearing surface 41 for boss 4 which pivots in a bore 62 of drum 6 which is also pivotally mounted.

Arbor 3 includes a bearing surface 31 which pivots in a bore 81 of cover 8 which is also pivotally mounted.

One-piece sub-assembly 10 comprises in its upper portion, above ratchet 2, a bearing surface 13 which pivots in a bore 51 of bar 5, or of jewel 52 of bar 5 which is stationary.

Arbor 3 comprises in its lower portion, below cover 8, a bearing surface 31, which pivots in a bore 91 of plate 9 or of jewel 92 of plate 9 which is stationary.

The shake of drum 6 is limited in lower abutment relative to ratchet 2 by the upper surface 61 of drum 6, which is limited by lower shoulder 12 of one-piece sub-assembly 10 which is equivalent to the lower abutment of ratchet 2.

The shake of ratchet 2 is limited in lower abutment relative to bar 5, by the upper shoulder 11 of one-piece sub-assembly 10, which is limited by lower surface 53 of bar 5 or of jewel 52.

The shake of cover 8 is limited in upper abutment relative to plate 9 by lower surface 82 of cover 8, which is limited by upper surface 93 of plate 9 or of jewel 91.

The boss diameter is not limited by anything other than the resistance of the material to shearing stress, nor is the diameter of arbor 3, which allows a very small arbor diameter to be created, and a very favourable K factor to be obtained.

In a specific configuration, the invention thus concerns a timepiece barrel 1 for pivotal assembly between a plate 9 and a bar 5 and comprising at least one spring 7 housed between a pivoting drum 6 and a cover 8. Spring 7 is hooked between drum 6 at its outer end, and an arbor 3 at its inner end, said arbor pivots integrally with a ratchet 2 about a pivot axis D. Barrel 1 comprises a one-piece sub-assembly 10 coaxial to pivot axis D, and contains, about a boss 4, at least ratchet 2 and/or arbor 3. According to the invention, this boss 4 comprises means for guiding in rotation drum 6 and means for guiding pivoting of barrel 1 in bar 5, and defines means for limiting the axial shake of drum 6 relative to bar 5, via a lower shoulder 12 on the side of drum 6, and an upper shoulder 11 on the side of plate 9. Arbor 3 comprises means for guiding barrel 1 in plate 9, in addition to means for guiding cover 8 when cover 8 is guided on barrel 1. Arbor 3 directly carries the inner end of spring 7. One-piece sub-assembly 10 comprises ratchet 2 and boss 4, which defines in the inner portion thereof a pipe, which includes an external bearing surface 41 on which drum 6 is pivotally guided, and a bore 45 into which arbor 3 is driven to pivot integrally with boss 4.

In yet another variant, very similar to that of FIG. 3, arbor 3 includes an externally threaded end which cooperates with an internal thread comprised in the pipe of boss 4, and which then replaces bore 45.

In short, the first variant of FIG. 1 is advantageous since one-piece sub-assembly 10 combines the functions of cover, ratchet, arbor and boss, with no machining complexity with the exception of hook 32 for hooking spring 7. There are three shake corrections. The advantage of this construction is that there is no limit to the diameter of the boss.

The second variant of FIG. 2 differs in that the ratchet is riveted to the arbor, there are three shake corrections. Here too, there is no limit on the boss diameter.

The third variant of FIG. 3 is advantageous as regards the inexpensive machining of hook 32 onto an arbor without a collar. The arbor is driven (or screwed) into the ratchet, and the drum pivots on the ratchet pipe, there are three shake corrections. Here too, there is no limit on the boss diameter.

The invention also concerns a timepiece movement 100 including at least one plate 9 and one bar 5 and one barrel 1 of this type.

The invention also concerns a watch 200 including a movement 100 of this type.

The invention claimed is:

1. A timepiece barrel for pivotal assembly between a plate and a bar and comprising:

at least one spring, housed between a pivoting drum and a cover and hooked between the drum at an outer end thereof and an arbor at an inner end thereof, the arbor pivoting integrally with a ratchet about a pivot axis;

a one-piece sub-assembly coaxial to the pivot axis and including, about a boss, at least the ratchet, wherein the boss comprises means for guiding in rotation the drum, and means for guiding pivoting of the barrel in the bar, and defines means for limiting axial shake of the drum relative to the bar, via a lower shoulder on the drum side and an upper shoulder on the plate side, wherein the arbor comprises means for guiding the barrel in the plate, and means for guiding the cover when the cover is guided on the barrel, wherein the arbor directly carries an inner end of the spring, and wherein the one-piece sub-assembly comprises the ratchet and the boss, which defines in an inner part thereof a pipe, which comprises an outer bearing surface onto which the drum is pivotally guided.

2. The barrel according to claim 1, wherein the one-piece sub-assembly comprises an internal thread into which the arbor is screwed via an externally threaded end comprised therein, pivoting integrally with the boss.

3. The barrel according to claim 2, wherein the arbor includes a bearing surface which has a smaller diameter than that of the cylindrical bearing surface of the boss, and carries the spring, on the shoulder on which the spring is immobilized by friction or welded, and wherein the bearing surface pivots in a bore of the plate or of a jewel comprised in the plate.

4. The barrel according to claim 1, wherein the drum carries the cover which pivots integrally with the drum and includes a bore that cooperates with a bearing surface of the arbor, and wherein travel of a lower surface of the cover is limited by an upper surface of the plate or of a jewel housed in the plate, a bore of the plate or of the jewel acting as pivot for the bearing surface of the arbor.

5. The barrel according to claim 1, wherein the shake of the drum is limited in lower abutment relative to the ratchet by an upper surface of the drum, which is limited by a lower shoulder of the one-piece sub-assembly, wherein shake of the ratchet is limited in lower abutment relative to the bar by an upper shoulder of the one-piece sub-assembly which is limited by a lower surface of the bar or of a jewel comprised in the bar, and wherein shake of the cover is limited in upper abutment relative to the plate by a lower surface of the cover which is limited by an upper surface of the plate or of a jewel comprised in the plate.

6. The barrel according to claim 1, wherein the spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, wherein the spring has a width to thickness ratio of between 3 and 23, and wherein the ratio between maximum radius of a bearing shoulder of the spring of the arbour and thickness of the spring is between 3 and 9.

7. A timepiece movement comprising at least one bottom plate and a bridge and a barrel according to claim 1.

8. A watch comprising a movement according to claim 7.

9. The barrel according to claim 1, wherein the ratchet is positioned between the drum and the bar.

10. The barrel according to claim 1, wherein the one-piece sub-assembly includes a bore into which the arbor is driven, pivoting integrally with the boss.

11. The barrel according to claim 10, wherein the ratchet is positioned between the drum and the bar.

12. The barrel according to claim 1, wherein the one-piece sub-assembly includes the arbor.

13. The barrel according to claim 12, wherein the ratchet is positioned between the drum and the bar.

14. A timepiece barrel for pivotal assembly between a plate and a bar and comprising:

at least one spring, housed between a pivoting drum and a cover and hooked between the drum at an outer end thereof and an arbor at an inner end thereof, the arbor pivoting integrally with a ratchet about a pivot axis;

a one-piece sub-assembly coaxial to the pivot axis and including, about a boss, at least the arbor, wherein the boss comprises means for guiding in rotation the drum, and means for guiding pivoting of the barrel in the bar, and defines means for limiting axial shake of the drum relative to the bar, via a lower shoulder on the drum side and an upper shoulder on the plate side, wherein the arbor comprises means for guiding the barrel in the plate, and means for guiding the cover when the cover is guided on the barrel, wherein the arbor directly carries an inner end of the spring, wherein the one-piece sub-assembly comprises the ratchet and the boss, which defines in an inner part thereof a pipe, which comprises an outer bearing surface onto which the drum is pivotally guided, and wherein the ratchet is positioned between the drum and the bar.

* * * * *